US007578531B1

(12) United States Patent
Leontaridis

(10) Patent No.: US 7,578,531 B1
(45) Date of Patent: Aug. 25, 2009

(54) LOCK ASSEMBLY FOR SLIDING DOOR/WINDOW PANELS

(76) Inventor: Athanasios Leontaridis, Vosporou 61, 171 24 Nea Smirni, Nea Smirni, Attiki (GR)

( * ) Notice: Subject to any disclaimer, the term of this patent is extended or adjusted under 35 U.S.C. 154(b) by 0 days.

(21) Appl. No.: 10/018,998

(22) PCT Filed: Jun. 28, 2000

(86) PCT No.: PCT/GR00/00023

§ 371 (c)(1),
(2), (4) Date: Dec. 26, 2001

(87) PCT Pub. No.: WO01/00952

PCT Pub. Date: Jan. 4, 2001

(51) Int. Cl.
*E05B 65/08* (2006.01)

(52) U.S. Cl. ..... 292/11; 70/97; 292/25; 292/45; 292/99; 292/129; 292/198; 292/207; 292/210; 292/229; 292/DIG. 46

(58) Field of Classification Search ..... 70/89, 70/90, 95–98; 292/227, 99, 198, 11, 25, 292/45, 129, 207, 210, DIG. 20, DIG. 46, 292/DIG. 47
See application file for complete search history.

(56) References Cited

U.S. PATENT DOCUMENTS

| | | | | | |
|---|---|---|---|---|---|
| 1,143,653 | A | * | 6/1915 | Smith | |
| 1,238,152 | A | * | 8/1917 | Kelloniemi | |
| 2,118,729 | A | * | 5/1938 | Hogan | |
| 2,668,071 | A | * | 2/1954 | Adams et al. | |
| 3,040,555 | A | * | 6/1962 | Wartian | |
| 3,912,311 | A | | 10/1975 | Carvell et al. | 292/216 |
| 4,106,239 | A | * | 8/1978 | Bancroft et al. | 49/449 |
| 4,995,649 | A | | 2/1991 | Magnusson | 292/175 |
| 5,188,406 | A | * | 2/1993 | Sterzenbach et al. | 292/210 X |
| 5,193,861 | A | * | 3/1993 | Juga et al. | 292/207 X |
| 5,286,073 | A | * | 2/1994 | Ui | 292/210 X |
| 5,516,162 | A | | 5/1996 | Takaishi | 292/37 |
| 5,735,557 | A | * | 4/1998 | Harvey | 292/207 X |
| 5,806,900 | A | | 9/1998 | Bratcher et al. | 292/137 |
| 6,139,074 | A | * | 10/2000 | Barnett et al. | 292/240 |
| 6,155,616 | A | * | 12/2000 | Akright | 292/207 |
| 6,327,879 | B1 | * | 12/2001 | Malsom | 70/97 |

FOREIGN PATENT DOCUMENTS

| | | | | |
|---|---|---|---|---|
| CA | 1 029 063 | | 4/1978 | |
| EP | 67075 | * | 12/1982 | 70/95 |
| FR | 2 367 892 | | 5/1978 | |
| GB | 2 274 874 | | 8/1994 | |
| SE | 112315 | * | 10/1925 | 70/96 |

* cited by examiner

*Primary Examiner*—Lloyd A. Gall

(57) ABSTRACT

A lock is described for sliding aluminium door or window panels, wherein are used discrete hooking and locking mechanisms. The hooking mechanism comprises an oblong hook profile (21) which rotates automatically in a hooking or unhooking position into a vertically extending frame profile (1) which bears a respective recession shaping, as the sliding door/window panel is simply pulled in the opening or shutting direction, respectively. The locking mechanism operates so that, when being controlled by the user, it is set in a position for capturing the hooking mechanism in the hooking position, by capturing the immobilisation arm of the above mentioned, otherwise freely and automatically rotating, oblong hook profile (21).

7 Claims, 9 Drawing Sheets

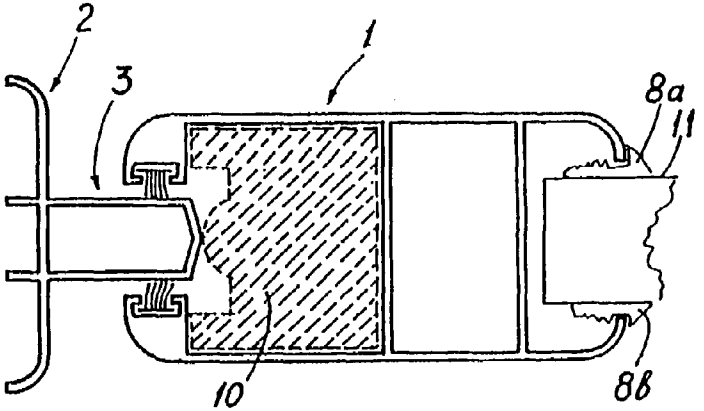
FIG. 1B "Prior Art"
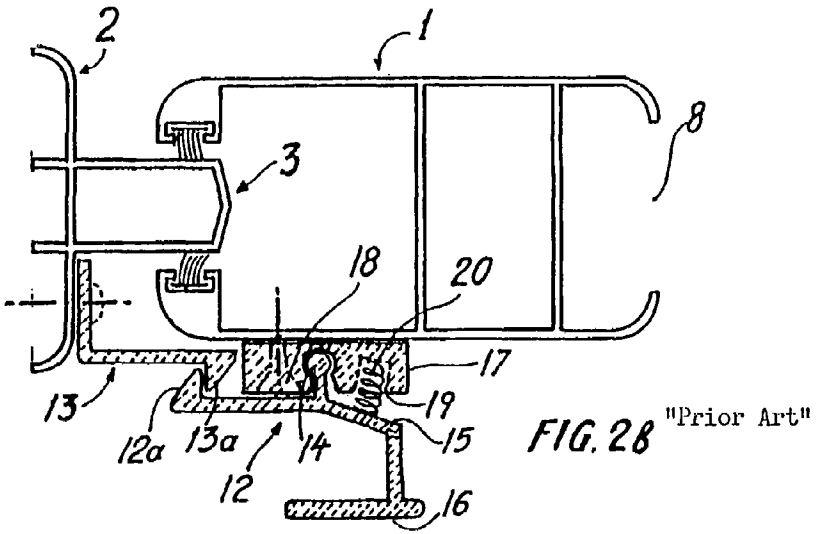
FIG. 2B "Prior Art"
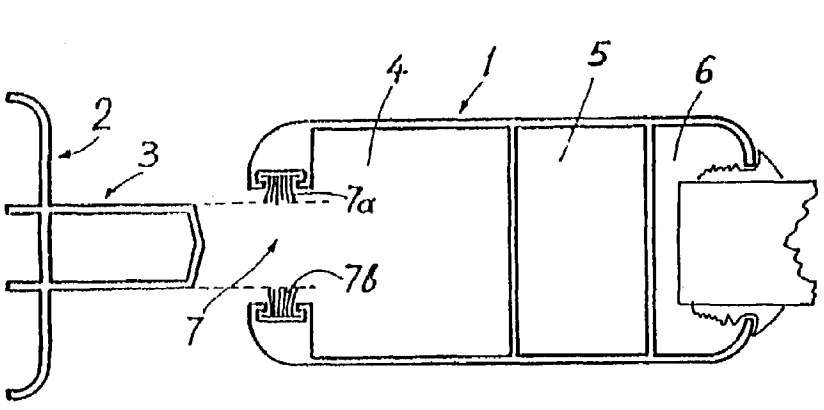
FIG. 1a "Prior Art"
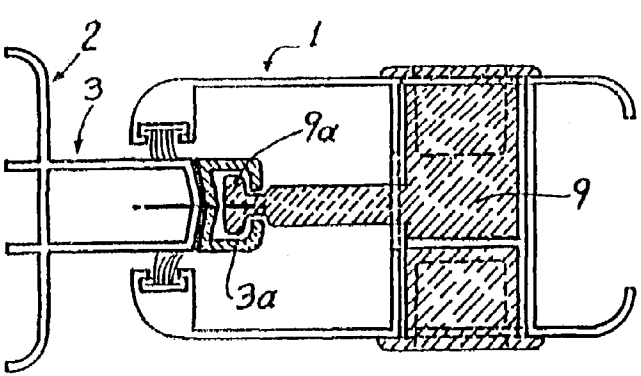
FIG. 2a "Prior Art"

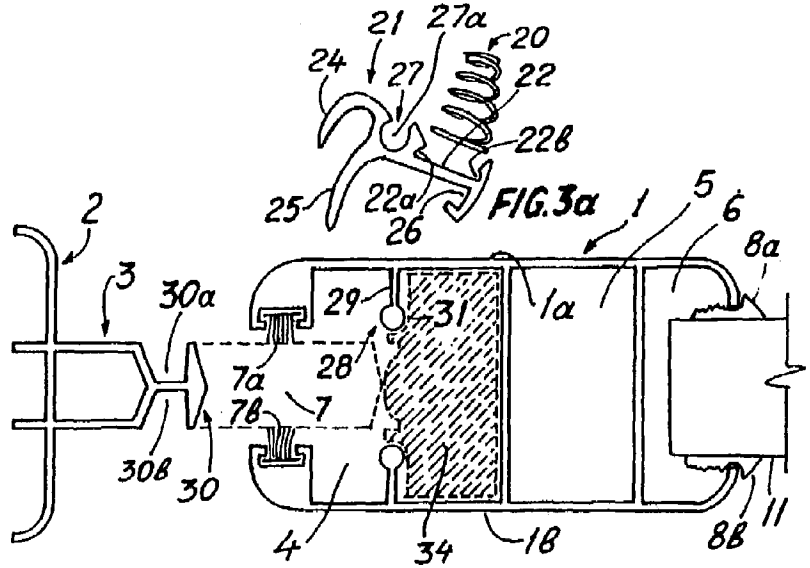
FIG. 3a
FIG. 3b
FIG. 3c
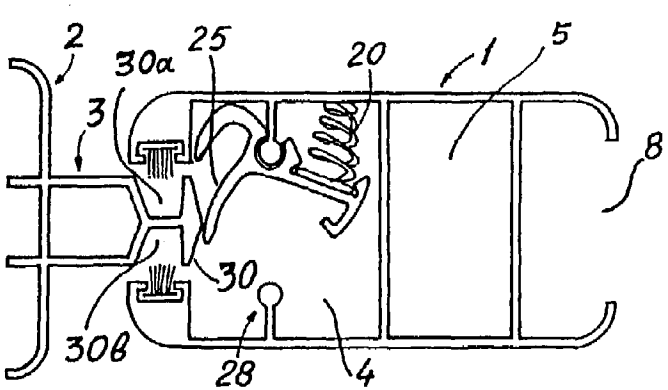
FIG. 4a
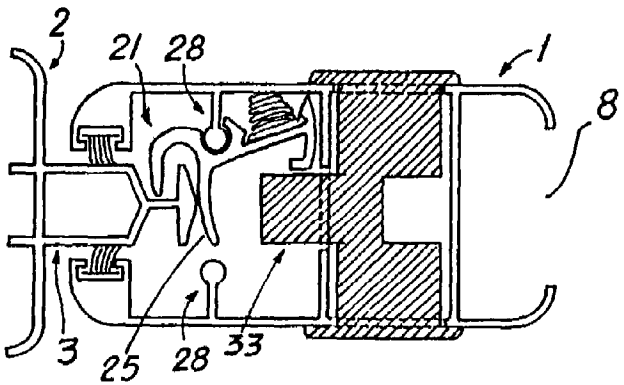
FIG. 4c
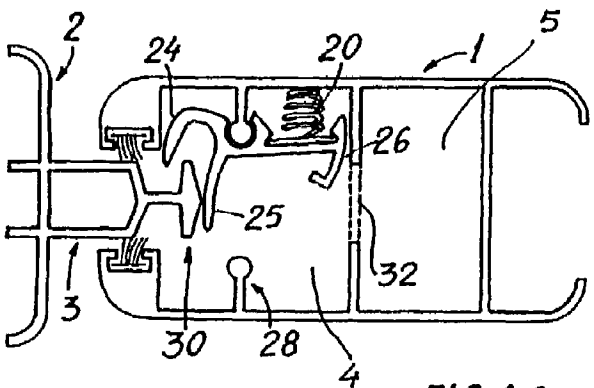
FIG. 4b

LOCK ASSEMBLY FOR SLIDING DOOR/WINDOW PANELS

THE TECHNICAL FIELD

The present invention refers to the field of the art of aluminium constructions in general and in particular to the filed of lock manufacturing, proposing a lock for sliding aluminium door and/or window panels. The proposed lock comprises discrete, independent parts of a hooking mechanism with a profile of an automatically revolving hook and a mechanism for locking the said revolving hook at the position wherein the sliding door/window panel locks.

BACKGROUND OF THE INVENTION

A lock similar to that proposed by the present invention has not so far been proposed, designed, manufactured or made commercially available.

A large variety of locks are used with sliding door and window frames, aiming at locking the sliding door/window panel into a facing part located within the frame.

A most common type of frame amongst aluminium frames is that which in the region wherein the sliding door/window panel locks is provided with a protruding and vertically extending part of the frame profile which penetrates into a front opening of the vertically extending part of the profile of the sliding door/window panel, which consists of parallel walls and ends to a rear opening wherein a glass or shutter panel is fitted. An internal or external lock can be alternatively used with this type of frame/sliding panel profiles.

The internal lock has the form of a hook, pin, or other similar locking means which, when being activated by a lock operating device, penetrates into a respective, suitably shaped facing part attached to the above mentioned vertically protruding main body of the frame which penetrates into the front opening of the profile of the sliding door/window panel. This technique of locking does not provide a great degree of security as the lock can be forged by violent exertion of pressure at the locking area or by slightly raising the sliding door/window panel.

On the other hand, an external lock has been proposed consisting of a hook profile attached onto a small plate at the external surface of the sliding door/window panel and pushed by a spring into a hooking position into a hook profile of the facing part which has a corresponding length and is attached onto the frame profile. This type of external lock may extend in length and hence provide for increased security, however causes an aesthetic degradation of the sliding door/window panel, due to the addition of the hook profile in the external view of the assembly, whereas it is still possible (though far more difficult) to forge the lock by exerting pressure along the length of locking. Another disadvantage of this technique is that the lock comes automatically to the locking position as the sliding door/window panel is shut, due to the oppositely cut oblique cross section of the hook into the sliding door/window panel and the hook in the facing part, thus leading to undesired locking outside the space, e.g. outside, in the balcony, as the lock can only be disengaged from the interior side of the door/window panel.

The object of the present invention is to advantageously overcome the disadvantages and drawbacks of the prior art and to provide an internal lock for the sliding door/window panel, featuring the characteristics of the abovementioned type of external lock, i.e. with the configuration of the hook profile.

The present invention, however, presents an absolutely discrete and independent part of the hooking mechanism with a hook profile of and a respective facing part profile and a locking mechanism of the profile in locked position, wherein this division of the lock of the invention into two parts results in the hooking region being at a certain, predetermined distance from the locking region, thereby presenting an increased resistance should pressure be exerted for forging the lock, as the exertion of such pressure which may force the rotating hook profile to a rotation in a particular unhooking direction as exerted in the hooking region, however leads to the exertion of counter pressure towards rotation in a direction where the discrete locking mechanism acts.

Another object of the invention is to offer the ability of an automatically rotating hook profile, both when the sliding door/window panel is shut, as well as when it opens and comes to the unlocking position, thus eliminating the case of the user being undesirably locked outside the space intended to be locked by the lock assembly of the invention. This ability is effected with a special arm of the hook profile, which, when touching upon the frontal surface of the vertical element of the frame profile which penetrates the sliding door/window panel can operate as a lever initiating the rotation of the hook profile in the hooking direction, whilst the sliding door/window panel moves in the locking position, without an interference of the user who only interferes in the process of activating the abovementioned locking mechanism which maintains the lock in the locked position.

Another object of the invention is to offer a variety of design variations of the combination of the hook profile inside the profile of the sliding door/window panel and of the profile of the facing part, either for one-sided locking with the rotating hook profile fitted in one wall of the profile of the sliding door/window panel or for two-sided locking with a pair of hook profiles fitted onto the two opposite walls of the profile of the sliding door/window panel. With the proposed solution of two-sided locking it is evident that the security offered by the lock increases.

Another object of the invention is to offer the ability of usage of independent profiles of plates, which can be attached both onto the internal walls of the sliding door/window panel profile, upon which the hook profile can be attached and rotated so that the invention may be applied to a series of different door/window panel profiles which do not feature such a provision, as well as onto the facing part of the frame panel for meeting the operational requirements of the lock assembly of the invention.

Another object of the invention is to offer the ability of using alternative embodiments of locking (immobilising) mechanisms of the proposed lock assembly of an automatically rotating hook profile in the locked position, amongst which there is proposed a locking mechanism which can convert easily and directly the direction of rotation of the locking tongue so that the same locking mechanism can be applied onto door/window panels sliding to the left or to the right.

Another object of the invention is to propose a sliding door/window panel profile, suitable for the reception of the hook profile and a corresponding frame profile suitable for shaping a correspondingly shaped receiving means of the facing part of the lock assembly of the invention, as well as the combination of such profiles of sliding door/window panel and frame profiles with alternative embodiments of locking (immobilising) mechanism of the proposed lock with automatically rotating hook profile in the hooking position, where all the above form a new series of sliding aluminium profile panels, principally characterized by the automatic door/window panel opening and shutting.

These and other advantages, objectives and characteristics of the present inventions will become evident in the detailed description of particular preferred embodiments of the invention.

BRIEF DESCRIPTION OF THE DRAWINGS

The invention will be made apparent to those skilled in the art with reference to the accompanying Drawings, which illustrate the invention in an indicative, but not restricting manner.

FIGS. 1*a* and 1*b* illustrate a cross sectional view of a typical combination of commercially available profiles of the frame of a door or window panel and of the facing part in the open and shut position, respectively.

FIGS. 2*a* and 2*b* illustrate a cross sectional view of a typical conventional locking mechanism in a profile of the type of FIG. 1, where an external and internal lock is respectively used.

FIG. 3*a* illustrates a cross sectional view of a preferred embodiment of the hook profile for the lock assembly of the invention with an indicative type of co-operating spring.

FIG. 3*b* illustrates a cross sectional view of a preferred embodiment of the profile of the facing part of the lock assembly of the invention, which in effect consists of two grooves on either side of the protruding main part of the frame profile.

FIG. 3*c* illustrates a cross sectional view of a preferred embodiment of the sliding door/window panel frame profile, the side walls of which bear vertically extending cylindrical shafts for the reception of the hook profile. In this Figure, the profile of the sliding door/window panel is illustrated cut in the region wherein a pad for determining the termination of the penetration of the facing part profiles into the sliding door/window panel.

FIG. 4*a* illustrates the lock of the invention assembled in the open position.

FIG. 4*b* illustrates the lock of the invention assembled in a position in between the open and shut positions.

FIG. 4*c* illustrates the lock of the invention in a shut position where the hook profile is maintained fixedly locked by the locking mechanism.

DETAILED DESCRIPTION OF PREFERRED EMBODIMENTS

Figure 5:
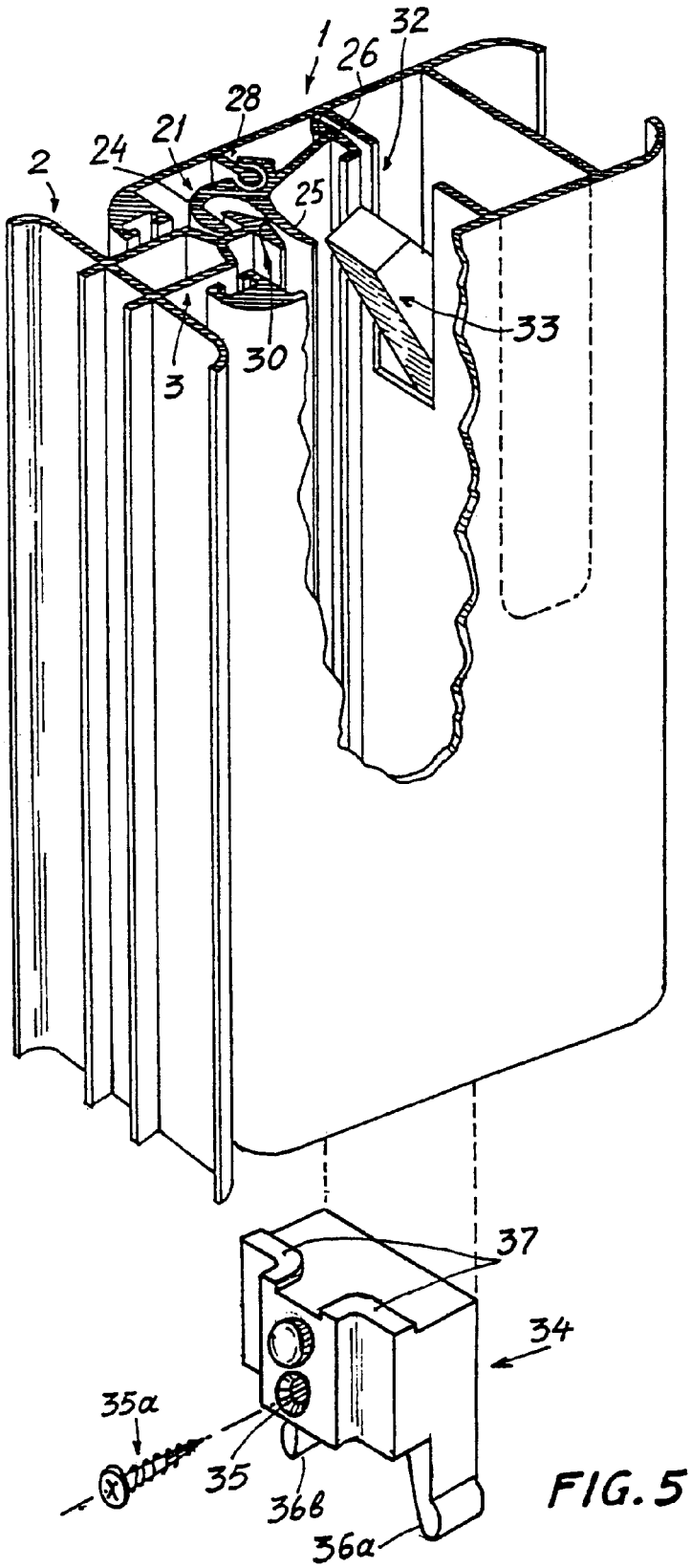
FIG. 5 illustrates a perspective view of the profile of the sliding door/window panel where the lock of the invention is attached, and a respective frame profile with a vertically extending member bearing a suitable groove configuration for the reception of the hook profile of the lock assembly.

With reference to the accompanying Figures, indicative but not restricting embodiments of the invention will be described.

FIG. 1*a* illustrates a typical combination of profile 1 of a sliding door/window panel and in particular of the vertically extending part thereof at the side whereat the door/window panel opens or shuts, with a co-operating frame profile 2 containing the part 3 which, when the sliding door/window panel shuts, penetrates into the opening 7 of the profile 1, such opening being tightened by the brushes 7*a* and 7*b* on either side thereof.

The profile 1 comprises three discrete chambers, 4, 5 and 6 where the first chamber 4 is the one whereto at least one plastic pad 10 is fitted which determines the termination of penetration of the part 3 into the profile 1 as illustrated in the cross sectional view of FIG. 1*b*. In another horizontally directed cross sectional view as illustrated in FIG. 2*a*, the part 3 is attached to a facing part element 3*a* which takes the shape of the receiving means for the accommodation of a terminal part 9*a* which may have the form of a bolt, a tongue, a hook, etc. and is arranged at the end of the lock main body 9 which moves reciprocatively vertically, so that either the terminal part 9*a* penetrates into the facing part element 3*a* and the door/window panel locks or it is moved away from it and the door/window panel opens. This indicative type of lock is conventionally known as an inbuilt lock at the door/window panel, whereas FIG. 2*b* illustrates a variation of an external lock to the door/window panel 1.

In the case of an internal lock in the central chamber 5 of the profile 1, the lock is usually fitted with detachment of a suitable part on either side, so that the lock mechanism can be introduced and is then covered externally with a cover plug means and internally with another cover plug means bearing a means for controlling the operation of the lock. Finally, in the terminal internal chamber 6 of the profile 1 of the door/window panel, an opening 8 exists through which the glass panel 11 or the shutter door/window panel is introduced into the profile 1 of the sliding door/window panel, this opening 8 being tightened by the elastic pads 8*a*, 8*b* on either side of the glass panel.

The external to the sliding door/window panel 1, lock variation of FIG. 2*b* has the shape of a hook profile 12 ending into a terminal hook 12*a*, whereas the facing part is another profile 13 with a terminal hook 13*a*, independent of the main body 3 of the frame profile 2 which penetrates through the opening 7 into the profile 1 of the door/window panel. The hook profile 12, apart from the main body at the end of which the hook 12*a* is provided, contains an oblong cylindrical body 14 with which it penetrates into a respective cylindrical plate frame 17 attached to the profile of the door/window panel 1, via screws 18, so that the hook profile 12 can be rotated inside the panel at the region provided for the penetration of the oblong cylindrical body 14 to the plate 17. The plate 17 also contains a cavity 19, within which a spring 20 is introduced, this spring being enclosed and compressed between the bottom of the cavity 19 of the plate 17 and one arm 15 of the hook profile 12 which finally extends into a terminal arm-handle 16. As illustrated in FIG. 2*b*, the spring 20 extends so that it exerts pressure upon the hook profile 12 when the latter is at the "shut" position where the terminal hook 12*a* is coupled to the terminal hook 13*a* of the facing part profile 13.

It is noted that this type of external lock with hook profile, comes automatically to the shut position, due to the inversely and obliquely cut of the ending of the terminal hook 12*a* of the hook profile 12 and the terminal hook 13*a* of the profile of the facing part 13, but the automatic conversion into unhooked position is not possible unless the handle 15 is pressed that temporarily compresses the spring 20 which is nested between the cavity 19 of the plate 17 and the wall 15 of the oblong hook profile 15. This operation, with the automatic and unwanted locking and the non-automatic conversion into unhooked position may lead to cases of locking the user in the space outside the surface of the door/window panel whereupon the lock is mounted. Furthermore, the overall construction of the lock with a hook profile and additional respective hook profile in the facing part, which protrudes from the sliding door/window panel and the frame, on one hand reduces the aesthetics of the frame and on the other hand is a significant operational disadvantage which limits applicability of the lock assembly as it is not possible to use this type of lock in the limited space between adjacent door/window panels which slide one next to each other (glass panel/shutter panel).

As mentioned hereinabove in the introductory part an object of this invention is to provide a lock for sliding aluminium door and window frames consisting of a hook profile where hooking and unhooking operations are automatically effected and where the locking and unlocking operations from the hooking positions are performed purposely through a particular manual procedure. Simultaneously, the overall lock is built inside the profile of the sliding door/window panel and improves and eliminates aesthetic deformations and limitations of the embodiment of conventional locks, also providing for increased security.

As illustrated in FIG. 3*a*, the hook profile 21, according to an indicative preferred embodiment of the present invention contains a flat surface 22, at the ends of which recessions 22*a*, 22*b* are provided for seating and nesting the spring 20. At the inner end of the flat surface 22 and at the side of the recession 22*a*, a centre 27 is formed for the connection of the hook profile 21 so that it can thereby be rotated. In the case illustrated in FIG. 3*a*, the centre 27 for the connection of the hook profile 21 so that it can rotate is an open cylindrical cavity 27*a*.

Thus, on one side of the centre of the rotatable connection 27 the flat surface 22 for the reception and seating of the spring 20 extends, which ends to a terminal arm 26 which constitutes the immobilisation arm as it co-operates with a locking tongue 33 for elimination of the ability of the hook profile 21 to rotate and for securing it at the locked position.

On the other end of the centre of the rotatable connection 27, the terminal arm 24 extends which constitutes the hooking arm, whereas between the terminal hooking arm 24 and the terminal immobilization arm 26, an arm 25 is provided which constitutes the means of activation of rotation of a certain arc length of the hook profile 21 in the direction of engagement of the hooking arm 24 to the recessions of the facing part when the sliding door/window panel shuts. Thus, the sliding/rotating arm 25 constitutes, as it is adjacent to the frontal surface 30 of the facing part, the lever for activating the rotation of the hook profile 21 in one or the other direction of rotation and renders the hook profile 21 able to rotate automatically.

The hook profile 21 is connected, as indicatively illustrated in FIGS. 4*a*, 4*b*, 4*c*, onto a vertically extending flat surface 28 which protrudes vertically to the surface of at least one of the parallel walls 1*a*, 1*b* of the sliding door/window panel profile and has a length at least equivalent to the length of the hook profile 21, whereas it bears a terminal shape of a centre of rotatable connection of the oblong hook profile.

A method to pivotally connect the hook profile 21 onto the vertically extending surface 28 of the wall 1*a* and 1*b* of the profile 1 is by the attachment of the terminal cylindrical shaft shaping 31 of the surface 28 to the similar in diameter reception groove 27*a* for the hook profile 21. Alternatively, as illustrated in FIG. 9*c*, another method to pivotally connect the hook profile 21 onto the vertically extending surface 28 of the wall of the profile 1 is by the attachment of a cylindrical shaft 27*b* of the profile of the hook profile 21 to a cylindrical reception groove 31*a* which is the terminal shaping of the vertically extending surface 28 to the wall 1*a* and/or 1*b* of the profile 1.

FIGS. 4*a*-4*c* illustrate and make evident the ability of rotation of the hook profile 21, as the sliding/rotating arm 25 is adjacent to the frontal surface 30 of the facing part 3 which contains one groove or a pair thereof (30*a* and 30*b*) where a hooking arm may penetrate alternately, when the door/window panel is pulled into the shut position. In the shut position, as illustrated in FIG. 4*c*, it is possible by projecting the locking tongue 33, via an opening 32 to the separation surface between the chambers 4 and 5 of the profile 1, to capture the end of the immobilization arm 26 so that the mechanism is kept in a locked position.

FIG. 4*a* illustrates the position of the rotating hook profile 21, when while unhooked, its rotation starts by the collision of the arm 25 at the frontal surface 30 of the facing part, and continues as illustrated in FIG. 4*b* (intermediate stage) for terminating in the hooking position as illustrated in FIG. 4*c*.

In the cross sectional view of FIG. 3*c*, a pad 34 is illustrated, not in the region of the extension of the hook profile 21, but above or below it; the pad is illustrated in perspective in FIG. 5 and is attached to the profile 1 by the passing of the screw 35*a* via the hole 35 to a side surface, has the suitable cavity formation on either side of its frontal surface for being easily introduced via the vertically extending surfaces 28 at the walls 1*a*, 1*b* of the profile 1 and bears spring activated legs on either side 36*a*, 36*b* that contribute to its rigid adherence to the vertical walls 1*a*, 1*b* of the profile 1, on either side. The hook profile 21 slides during its rotation onto the surface 37 of the pad element 34, whereas as evident from the comparison of FIGS. 3*c* and 1*b* (where the respective pad 10 of the conventional technology is illustrated) the pad 34 of the present invention permits a significantly increased depth of penetration of the part 3 of the frame relative to the conventional technology and thus defines the contact surface of the vertically extending part 3 with the brushes on either side for tightening behind the one at least groove provided to it for the accommodation of the hook profile, thereby significantly increasing the feeling of security.

Figure 6C:
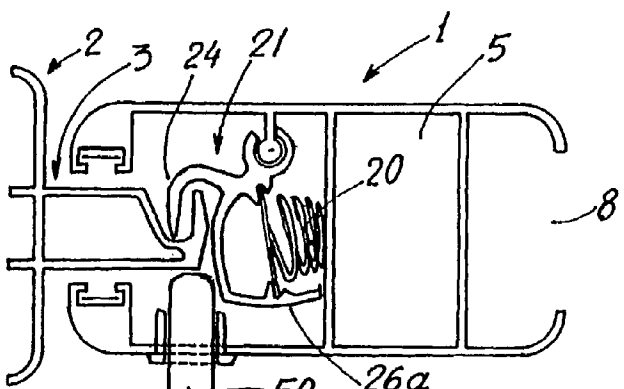
FIGS. 6*a*, 6*b*, 6*c* illustrate a cross sectional view of alternative variations of a combination of a hook profile and a co-operating facing part according to an embodiment of the invention for one-sided locking.
Figure 6A:
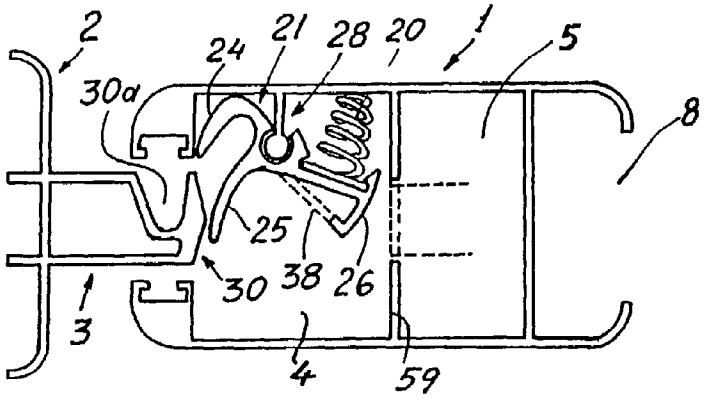

FIG. 6*a* illustrates a variation of the hook profile 21 with the indicative addition of a reinforcing rib 38 extending between the arms 25 and 26, whereas the facing part 3 is shown with just one single-sided groove 30*a* for penetration of the hooking arm 24. It is evident that such reinforcing ribs can be designed and applied to several other positions, arrangements and shapes for the reinforcement of the overall hooking profile 21.

Figure 9B:
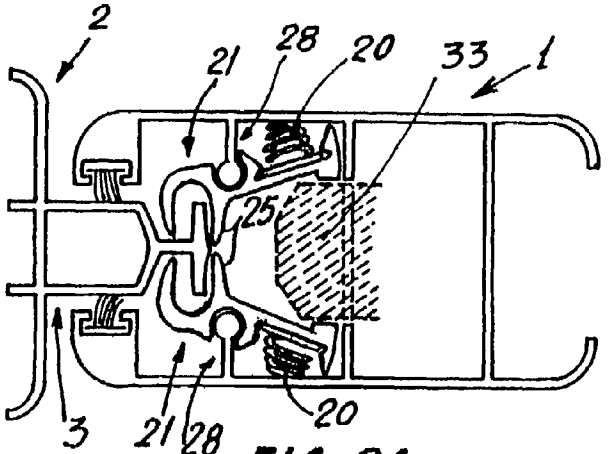
FIGS. 9*a* and 9*b* illustrate a lock arrangement according to an embodiment of the invention for two-sided locking.
Figure 9D:
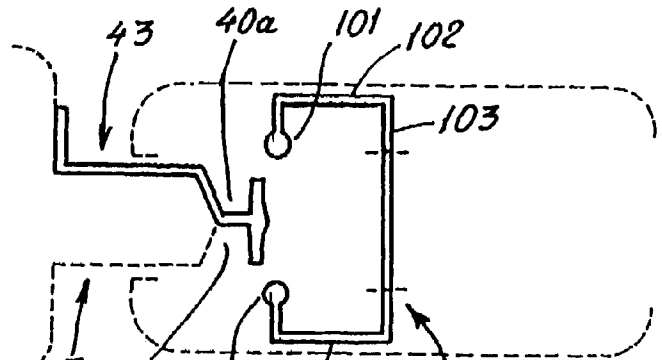
FIG. 9*d* illustrates a cross sectional view of an indicative type of an independent profile attachable to an existing series of aluminium frame profiles, on the one hand for the cylindrical shaft of attachment of the rotating hook profile and on the other hand for the co-operating facing part bearing a groove for the reception of the hook profile in the case of two-sided locking.
Figure 9A:
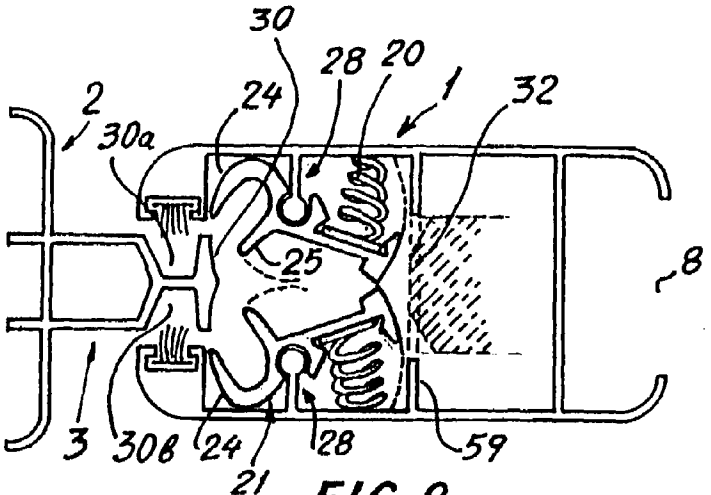
Figure 9C:
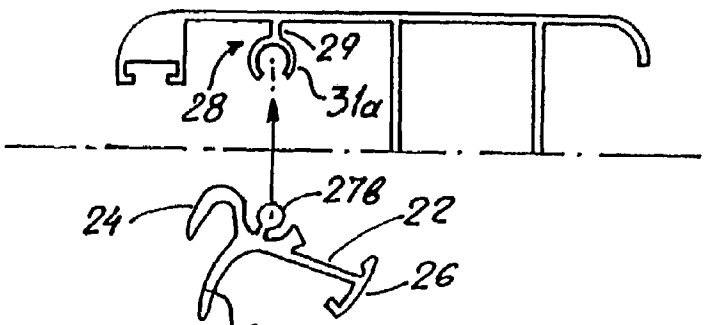
FIG. 9*c* illustrates a variation of a hook profile co-operating with a variation of its cylindrical shaft of attachment.

FIGS. 9*a* and 9*b* illustrate, in a hooking and unhooking position respectively, an arrangement of bilateral locking with a hook profile 21 to each of the opposite parallel walls 1*a*, 1*b* of the profile 1, whereas the facing part profile 3 bears a pair of grooves 30*a*, 30*b* for the reception of the hooking arms 24 of the two opposite hook profiles 21. The synchronized rotation of the two opposite hook profiles 21 is evident, again with the co-operation of the sliding arms 25 with the front surface 30 of the main body of the facing part 3. It must be noted, that for evident space considerations, the differentiation in the design of the sliding/rotating arms 25 relative to those illustrated in the previous FIGS. (e.g. FIG. 6*a*) which instead of having a curvature similar to that of the hooking arm 24, they have the opposite curvature, whereas the front surface 30 of the main body of the facing part 3, is also shaped with the same curvature.

FIG. 9*d* illustrates the ability to add independent additional profile elements 108 for developing two oppositely extending cylindrical shafts 101 for the reception of respective elements of a rotating hook 21, where the profile 108 has a generally rectangular cross section with a surface 103 adjacent to the surface in between the chambers 4, 5 of the profile 1 and surfaces 101, parallel, adjacent to the opposite side walls 1*a*, 1*b* of the profile 1. Respectively, an independent profile 43 is illustrated which can be adapted to an existing facing part 3 profile for the formation of suitable grooves 40*a* and 40*b* for the reception of the hooking arms 24. With the addition of such independent profiles 108, 43 with any necessary technical variations, the embodiment of the idea of the invention into a series of frames, which do not feature the necessary elements for this purpose, is made possible.

Figure 7A:
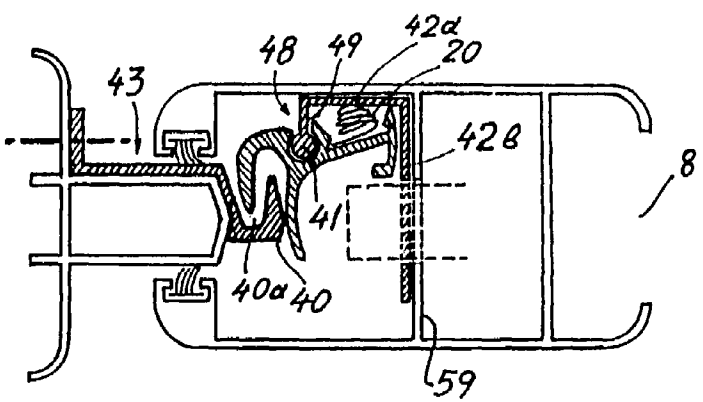
FIGS. 7*a* and 7*b* illustrate a cross sectional view of an indicative hook profile wherein both the cylindrical shaft for attaching the rotatable hook profile, as well as the facing part constitute independent profiles attached onto existing series of aluminium profile panels.

Whereas the illustrated additional profiles 108, 43 are used for the embodiment of the invention for the production of a two sided-hooking lock, similar solutions are proposed for the one-sided hooking lock as well. As illustrated in FIG. 7*a*, the use of the additional profile 48 is possible for one-sided hooking, where the vertically extending flat surface 49 bears a terminal shaping of cylindrical shaft 41 for reception of the hook profile 21 and is connected to the wall 1*a* or 1*b* via an angular part 42*a*-42*b*, one side of which is adjacent to the wall 1*a* or 1*b* and the other side is adjacent to the surface in between the chambers 4, 5 of profile 1. Similarly, the additional facing part element 43 follows the shape of the main part of the facing part 3 and forms a terminal groove 40*a* for the reception of the hooking arm 24 of the hook profile 21.

It is evident that in any case, the embodiment of the above-mentioned interchange of cylindrical shaft and cylindrical reception groove in the centres of rotatable connection of the hook profile 21 and the vertically extending surface 28 is possible.

According to a first indicative preferred embodiment of the invention, applicable to locks for one sided or two-sided locking with extending elements built into the walls 1*a* and/or 1*b* of the profile 1 protruding vertically, with terminal shaping of a centre for rotation permitting connection of the hook profile(s) 21 or with additional independent elements for the development of such centres of rotation permitting connection as disclosed above, the locking mechanism which captures the end(s) of the immobilization arms of the hook profile (s) 21 and thus immobilizes in a hooking position one or two respective hooking arms 24 is a mechanism in chamber 5, located next to chamber 4 where the hook profiles 21 are installed, which mechanism operates so that a locking tongue 33 protrudes when it takes the locking position, through an opening 32 in the surface in between the chambers 4-5, this locking tongue 33 capturing the rear part 26*a* of one or two immobilization arms 26 of the respective profiles of the longitudinal hook 21.

Figures 10A, 10B, 10C:
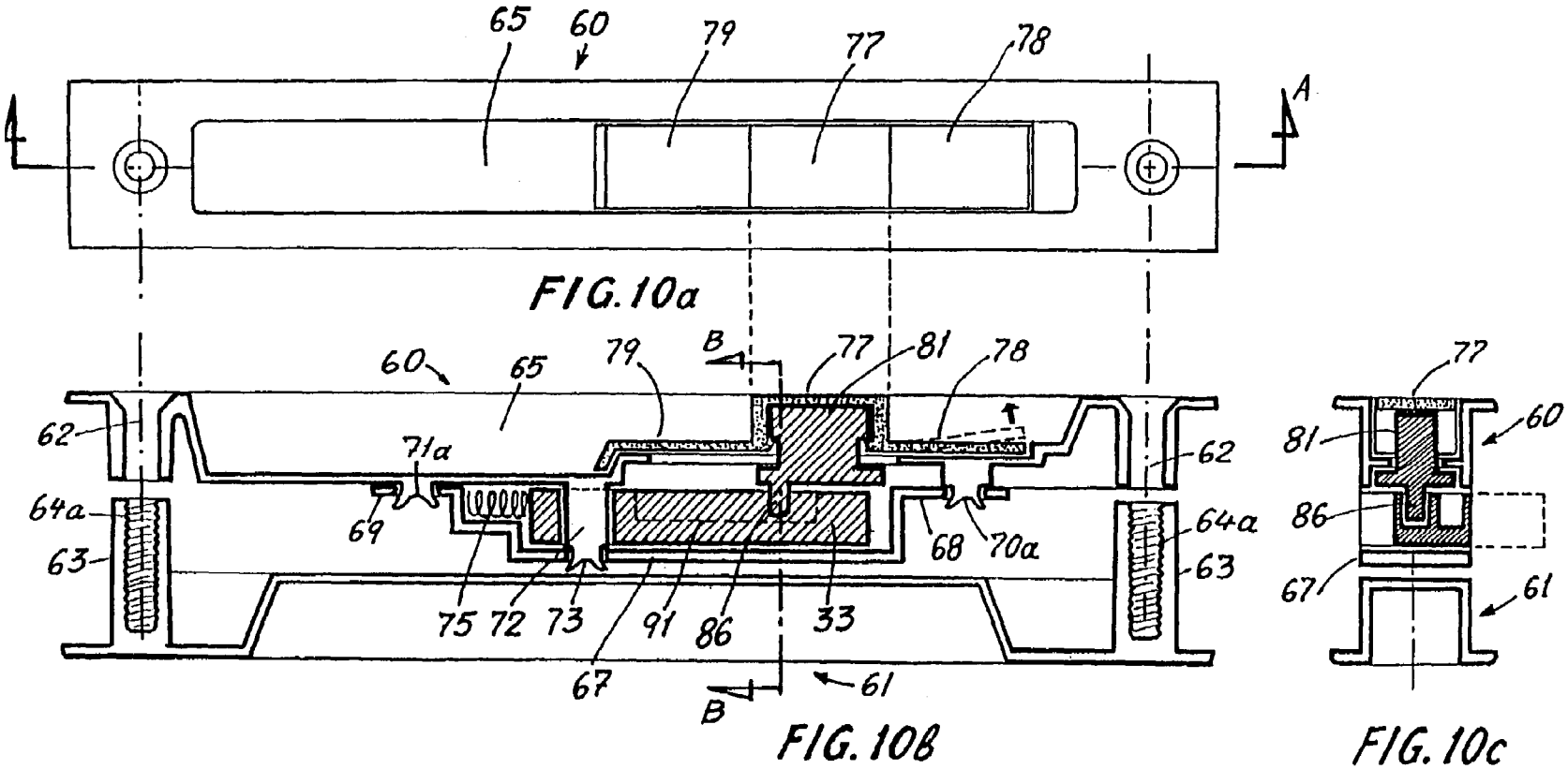
FIG. 10*a* illustrates a view of an indicative preferred embodiment of the invention for the hooking mechanism of the hook profile and for locking the lock.
FIG. 10*b* illustrates the cross sectional view A-A of the mechanism illustrated in FIG. 10*a*.
FIG. 10*c* illustrates the cross sectional view B-B of the mechanism illustrated in FIG. 10*a*.
Figure 10D:
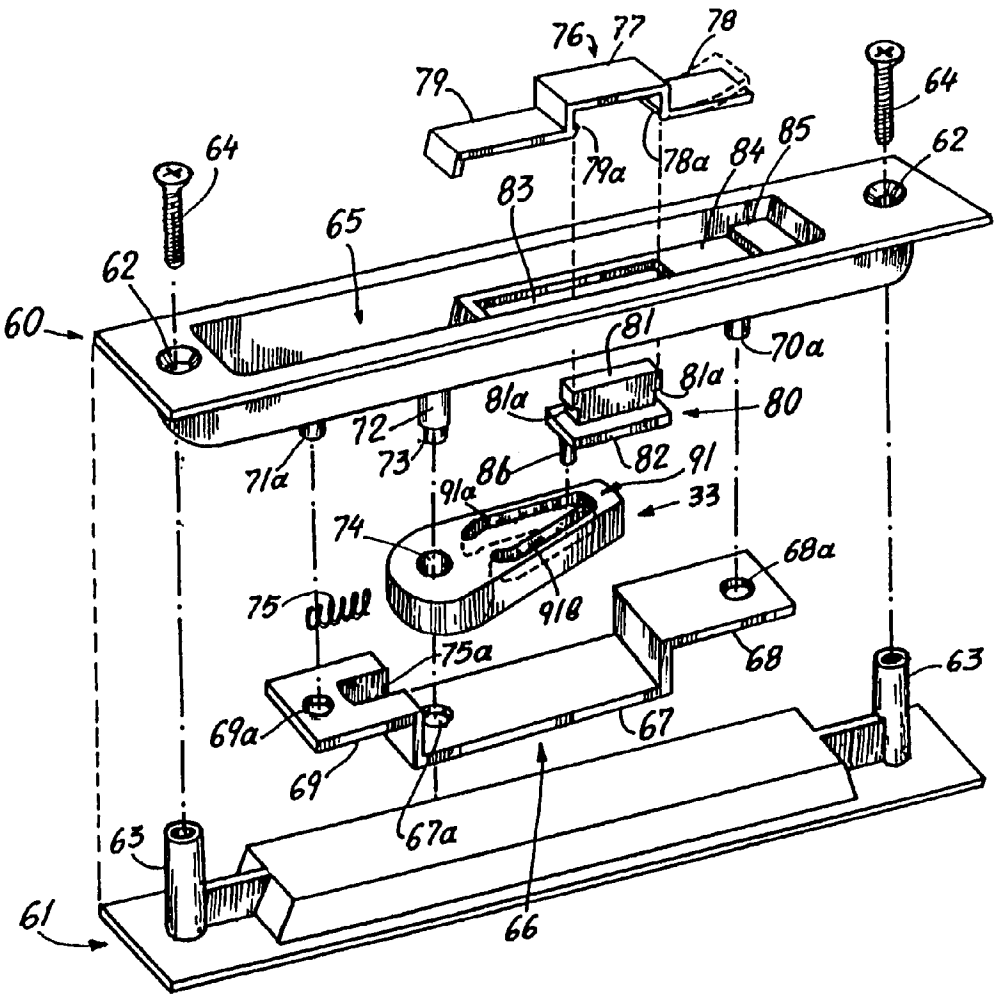
FIG. 10*d* illustrates a perspective view of the mechanism of FIGS. 10*a, b, c*, disassembled into its constituent parts.

According to the first indicative preferred embodiment of the invention, the locking mechanism is presented in a development disassembled to the parts that constitute it in FIG. 10*d*, in an external view of the internal handle in the FIG. 10*a*, in a cross sectional view AA of FIG. 10*b* in FIG. 10*c*. As illustrated, the mechanism contains the following elements:

1) Main body of internal handle 60 which is fitted into an opening of the profile 1 in the region of the chamber 5 and contains a rectangular cavity 83 which is covered by a plastic cover 76 which features a central elevated part 77 and on either side of it the same-level blades 78 and 79, where the flat blade 78 moves reciprocatingly up and down, adjacent to the surface 84 which is located next to the opening 83.
2) The button 80 which consists of a rectangular surface 82 where a rectangular part 81 is provided onto one side of it, bearing recessions 81*a* on either side, through which it fastens to respective protrusions 78*a*, 79*a* under the central elevated part 77 of the plastic cover 76 and is built into it. On the other side of the rectangular surface 82, a pin 86 extends which is attached to a groove of the locking tongue 33.
3) A locking tongue 33 which contains a surface with a groove 91 in the form of a fork with legs 91*a*, 91*b* on either side, within which the pin 86 of the button 80 penetrate and a terminal hole 74 through which it is connected off-centre and so that it can rotate around a small shaft 72 of the main body of the internal handle 60.
4) Metallic or plastic cover 66, which contains a central elevated part 67 and same-level blades 68 and 69 on either side. The locking tongue 33 seats into the cavity formed in the region of the raised part 67. The locking tongue 33 is nailed, with a use of a nail 73 along the small shaft 72, as the nail passes through the openings 67*a* of the elevated part 67. The same-level blades 68, 69 bear holes 68*a*, 69*a* respectively for being nailed to the nails 70*a*, 71*a* of the main body of the internal handle 60, and
5) Main body of the external handle 61 positioned into an opening of the profile 1, in the region of the chamber 5, exactly opposite the main body of the internal handle, and contains cylindrical tubes 63 on either side with an internal spiral, whereto a pair of screws 64 is nailed, these screws passing through holes 62 of the main body of the internal handle 60.

The locking mechanism of the hook profile(s) 21 in the hooking position operates when the button 80, built into the plastic cover 76 reciprocates due to the reciprocation of the plastic cover itself; then the off-centre rotating locking tongue 33 is pushed, via the bolt 86 which tracks the specially curved track of one of the grooves 91*a*, 91*b*, for performing a certain arc length rotation so as to protrude via the opening 32 to the surface in between the chamber 4 of the profile 1 where the hooking mechanism is installed and the chamber 5 of the profile 1 where the locking mechanism is installed. In this manner, the hocking arm 24 of at least one hook profile 21 is captured via the coupling of the terminal immobilization arm into the recession of the facing part.

According to yet another preferred embodiment of the invention, the same locking mechanism of the hooking arm 24 of at least one hook profile 21 inside at least one suitably shaped recession of the facing part, may be similarly used for a sliding door/window panel which closes to the right or to the left, where the only necessary modification for the lock assembly to function either way is the assembly of the bolt 86 alternately to the right or left special curved groove track 91*a* or 91*b* of the locking tongue 33, so that the direction of rotation of a certain arc length performed by the locking tongue 33 is altered. The aforementioned only necessary modification may be effected with the overall locking mechanism assembled by a slight temporary raising of the blade 78 of the plastic cover 76, so that this is temporarily supported by an elevated surface 85, relative to the surface 84 onto which the blade 78 is operationally adjacent and in the vicinity of it, so that the bolt 86 is removed from one of the two legs of the pair of legs 91*a* or 91*b*, into which it has penetrated, and by tracing the top of the fork shaped groove 91 to enter again to the opposite leg of the pair of grooves 91*a* or 91*b*.

Figures 11A, 11B, 11C:
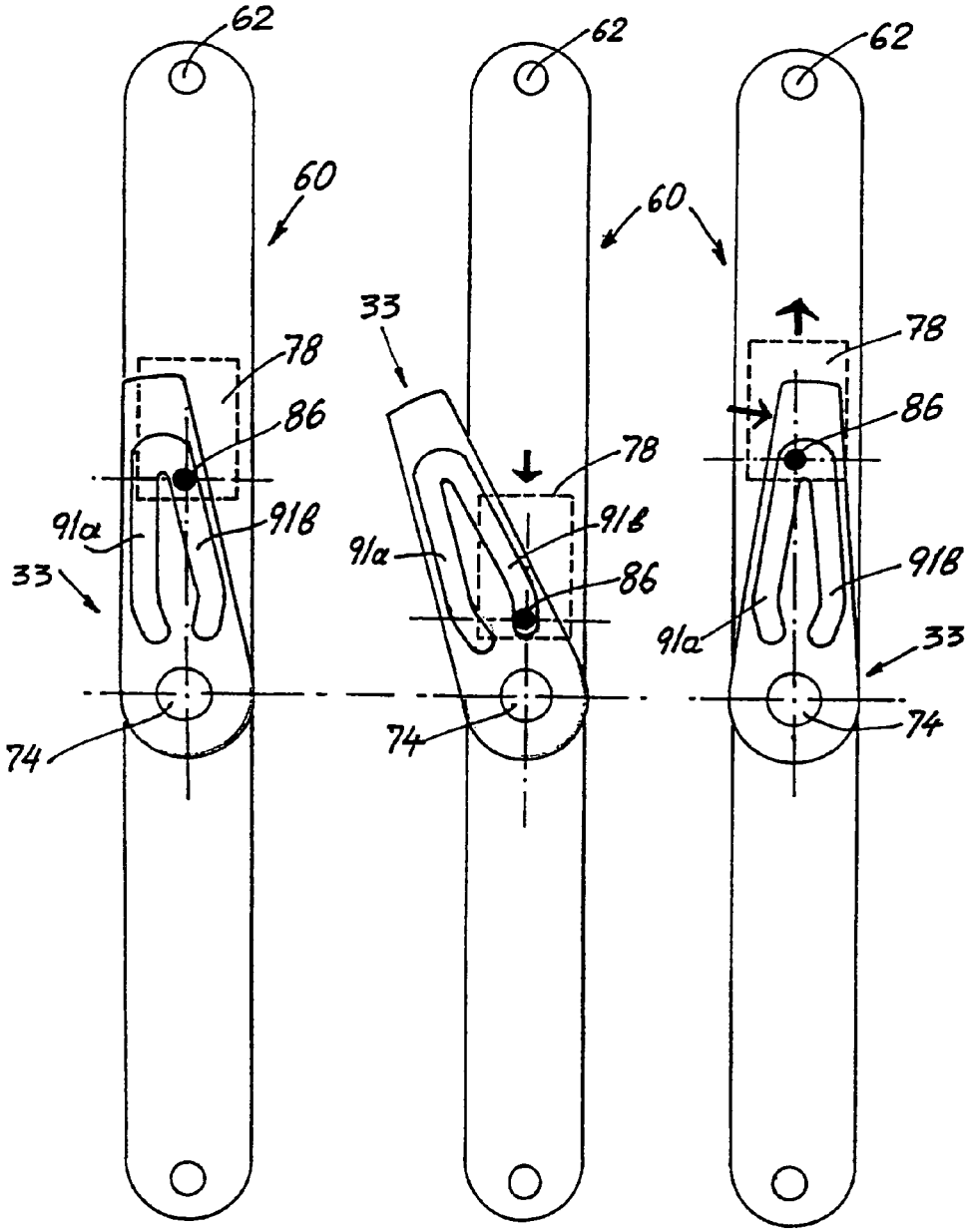
FIGS. 11*a*, 11*b*, 11*c* illustrate cross sectional views of alternative operating positions of the rotating locking tongue of the locking mechanism illustrated in FIG. 10*d*.

The operation of the locking tongue 33 which can be rotated on either side of the main body 60 of the locking mechanism is illustrated in FIGS. 11*a*-11*c*, where in particular in FIG. 11*a* the locking tongue is illustrated in a position aligned to the body 60 of the locking mechanism, whereat the tongue has retreated into the chamber 5 and does not protrude via the opening 32 of the surface in between the chambers 4-5 of the profile 1, in which case the hook profiles 21 located into chamber 4 are freely rotated. In the position illustrated in FIG. 11*a*, the locking tongue 33 has rotated so that the terminal part of the immobilization arm 26 of the hook profile(s) located at the chamber 4 of the profile 1 are able to rotate freely. In the position of FIG. 11*b*, the locking tongue 33 has been rotated so that the terminal part of the immobilization arm 26 of the hook profile(s) 21 fitted to the chamber 4 of the profile 1, has been captured. Finally, in the position illustrated in FIG. 11*c*, the blade 78 of the plastic cover 76 and the pin 86 have been raised, passing from the top of the fork-shaped groove 91 and entering into the other side 91*a* of the groove for conversion of the same mechanism for operation with a sliding frame that shuts in the opposite direction than the one of the previous case.

It must be noted that the arc of rotation performed by the hook profile 21 is in the order of 30 to 60 degrees and preferably 45 degrees.

According to an alternative, indicative embodiment of the invention, applicable to locks of the invention for one-sided hooking, with a vertically protruding extending element with terminal shaping as a centre for rotatable connection of the hook profile 21 built into the wall 1*a* or 1*b* of the profile 1, or with an additional independent element for the creation of such centre of rotatable connection as described above and is illustrated in FIGS. 7*a* and 7*b*, the locking mechanism which immobilizes the hook profile 21 is a button 50 which, when pushed by the user into a reciprocating movement, inwards and outwards, penetrates via the opening of the wall 1*b* of the profile 1 opposite to the wall 1*a* at which the hook profile 21 is connected and able to rotate.

Figure 6B:
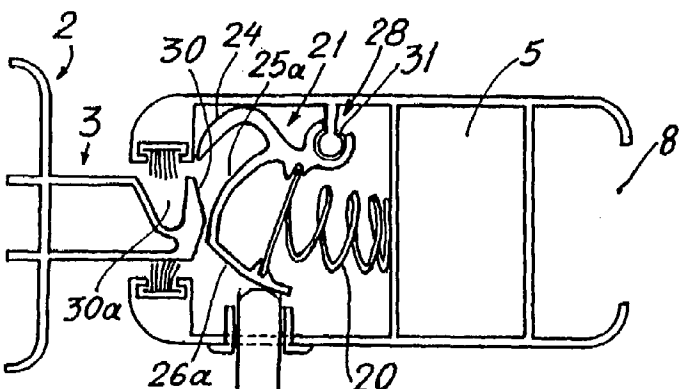

As illustrated in FIGS. 6*b* and 6*c*, along with the aforesaid modification of the locking mechanism, the mechanism of the rotating hook profile 21 is modified, which now contains a similar shaped hooking arm 24 which is followed by a sliding/rotating arm 25*a* in the internal side of which the flat surface 22 is provided with the recessions 22*a*, 22*b* on either side, whereupon seats the spring 20, whereas the immobilization arm 26*a* extends as an extension of the sliding/rotating arm 25*a* at an inclination in the order of 90 degrees.

This construction, as illustrated in FIG. 6*c*, can possibly capture the hook profile 21 to a hooking position, when the button 50 enters inside the chamber 4 and touches upon the hook profile 21 in the region at which the immobilization arm 26*a* and the sliding/rotating arm 25*a* meet.

Figure 8B:
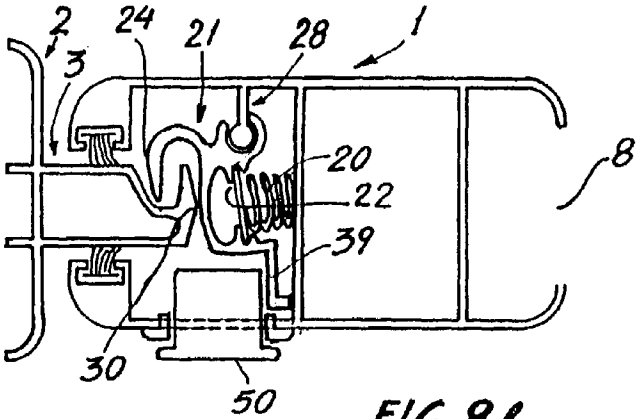
FIGS. 8*a* and 8*b* illustrate alternative indicative embodiments of the hook profile according to an embodiment of the invention for one-sided locking.
Figure 8A:
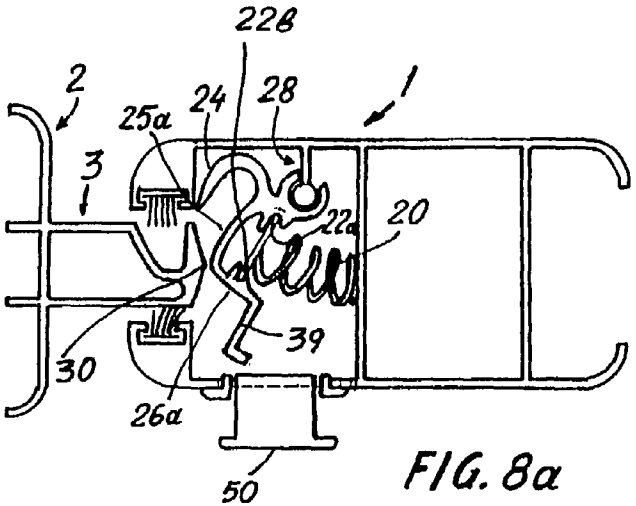

According to a further alternative embodiment, as illustrated in FIG. 8*a* (unhooking position) and in FIG. 8*b* (hooking position), as an extension of the immobilization arm 26*a*, a back leg ending 39 is provided, extending vertically to it, which actually constitutes the immobilization arm, as during the rotation of the hook profile 21 from the hooking to the unhooking position, it is displaced from the left to the right of the button 50 which is respectively pushed inwards or pulled outwards.

Figure 7B:
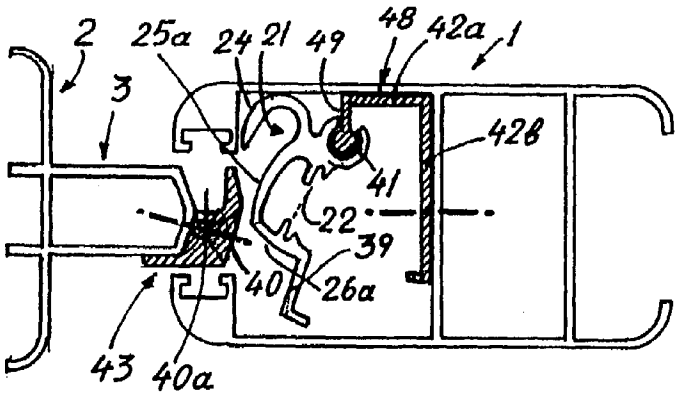

FIG. 7*b* illustrates an indicative embodiment of an additional part 48 for the formation of a centre for rotatable connection of the hook profile as well as of an additional facing part element 43 for the embodiment of the idea of the invention to a series of aluminium frame profiles that do not incorporate such characteristics.

It must hereby be noted that the description of the invention has been made by reference to indicative embodiments, which are however not restricting the scope of protection. Thus, any modification or alteration of the forms, dimensions, design, embodiments and combinations thereof of the totality or of individual elements of the proposed profiles, as long as it does not constitute a new inventive step and does not contribute towards the technical evolution of what is known, is considered to form part of the scope and aims of the present invention.

The invention claimed is:

1. Lock assembly for sliding door/window panels applicable to a series of frame profiles which in the region where the door/window panel shuts incorporate a vertically oriented protruding part (3) of the fixed frame profile (2) which is introduced into a frontal opening (7) of a vertically oriented sliding door/window panel profile (1) which comprises two parallel walls (1*a*,1*b*) and ends at a rear opening (8) into which a glass or shutter door/window panel is attached, comprising:

a hooking mechanism for the engagement of a hook into a suitably shaped recession of a facing part, said hooking mechanism being automatically activated to take a position of engagement when the sliding door/window panel shuts as said vertically oriented protruding part (3) of the fixed frame profile (2) enters through said frontal opening (7) in between the parallel walls (1*a*,1*b*) of said vertically oriented sliding door/window panel profile (1) and being also automatically deactivated taking a position of disengagement of said hook from said recession in said facing part when the sliding door/window panel opens as said vertically oriented protruding part (3) bearing the suitably shaped recession of said facing part is withdrawn through said frontal opening (7) of said vertically oriented sliding door/window panel profile (1), wherein said hooking mechanism features at least one hook profile (21) comprising a flat surface (22) with recessions (22*a*,22*b*) on either side thereof for the mounting of a compression spring (20), a centre (27) for rotatable connection of said hook profile (21), a frontal terminal hooking arm (24) adapted for the engagement into said suitably shaped recession of the facing part, a rear terminal arm (26,26*a*) for immobilizing said frontal terminal hooking arm (24) in the locked position of engagement within said suitably shaped recession of the facing part and a sliding/rotating arm (25), said sliding/rotating arm acting so as upon touching the frontal surface of said facing part initiating a rotation of a certain length of arc of said hook profile (21) in the direction of engagement of said hooking arm (24) into said recession of the facing part when the sliding door/window panel shuts, at least one vertically extending flat surface protruding at right angles from the interior surface of at least one of said parallel walls (1*a*,1*b*) of said vertically oriented sliding door/window panel profile (1) at a length corresponding to the length of said at least one hook profile (21) and bearing a terminal shaping of a centre for the rotatable connection of said at least one hook profile (21), a facing part located onto said vertically oriented protruding part (3) of the fixed frame profile (2) including a frontal terminal surface (30,40) whereupon collides said sliding/rotating arm (25) to initiate rotation of said at least one hook profile (21), said facing part being adapted to receive said at least one hook profile (21) with at least one vertically extending recession (30*a*,40*a*) within which is engaged said frontal terminal hooking arm (24) of said at least one hook profile (21), and a locking mechanism for immobilizing said frontal terminal hooking arm (24) of said at least one hook profile (21) within said suitably shaped recession of the facing part, thereby maintaining said frontal terminal hooking arm (24) in the locked position when acting upon said rear terminal arm (26,26*a*) for immobilising said frontal terminal hooking arm (24) in the locked position.

2. Lock assembly for sliding door/window panels as claimed in above claim 1, wherein said locking mechanism for immobilising said frontal terminal hooking arm (24) of said at least one hook profile (21) within said suitably shaped recession of the facing part, thereby maintaining said frontal terminal hooking arm (24) in the locked position is alternatively selected to comprise:

a locking tongue (33) extending through an opening (32) along the surface separating a frontal chamber (4) of said vertically oriented sliding door/window panel profile (1) from a central chamber (5) thereof wherein is installed a mechanism for the operation of said locking tongue (33), said locking tongue (33) being activated via this mechanism to perform a rotation of a certain arc length and block movement of said rear terminal arm (26,26*a*) of said at least one hook profile (21) at a position in which said frontal terminal hooking arm (24) is engaged within said at least one vertically extending recession (30*a*,40*a*) of the facing part, or a manually reciprocatingly moving button (50) fitted into an opening at the wall of the frontal chamber (4) of said vertically oriented sliding door/window panel profile (1) which is located opposite to the wall whereupon said at least one hook profile (21) is rotatably connected, said button (50) acting so as to block movement of said rear terminal arm (26,26*a*) of said at least one hook profile (21) at a position in which said frontal terminal hooking arm (24) is engaged within said at least one vertically extending recession (30*a*,40*a*) of the facing part.

3. Lock assembly for sliding door/window panels according to the above claim 2, wherein the mechanism for the operation of said locking tongue (33) which initiates rotation of a certain arc length of said locking tongue (33) and blocks movement of said rear terminal arm (26,26*a*) of said at least one hook profile (21) at a position in which said frontal terminal booking arm (24) is engaged within said at least one vertically extending recession (30*a*, 40*a*) of the facing part, comprises:

a main body of internal cover plug means (60) which is fitted onto an opening of the profile (1) in the region of the chamber (5) and comprises a rectangular cavity (83) which is covered by a plastic cover (76), said plastic cover (76) featuring a central elevated part (77) and a pair of equivalent flat blades (78,79) on either side thereof, wherein one blade (78) of said pair of equivalent flat blades is reciprocatingly moving up and down tangentially to a surface (84) which is located next to said rectangular cavity (83);

a button means (80) which comprises a rectangular surface (82) with a rectangular portion (81) onto one side thereof, said rectangular portion (81) bearing recessions (81*a*) on either side thereof via which it locks into respective protrusions (78*a*,79*a*) located at the bottom of said central elevated part (77) of the plastic cover (76), and with an axial pin (86) on the other side of said rectangular surface (82) of the button means (80);

the locking tongue (33) which comprises a surface with a groove (91) in the form of a fork with right and left curvilinear legs (91*a*, 91*b*) on either side thereof, within which is alternatively introduced said axial pin (86) of the button means (80) so as to alternatively effect a clockwise or anticlockwise rotation of said locking tongue (33) and thereby render the same locking mechanism alternatively suitable for sliding door/window panels shutting either leftwards or rightwards, said locking tongue (33) further comprising a terminal hole (74) through which it is rotatably and off-centre connected on an axial shaft (72) extending underneath said main body of internal cover plug means (60);

a metallic or plastic cover means (66) comprising a central elevated part (67) and equivalent flat blades (68,69) on either side thereof, said locking tongue (33) being mounted within a cavity formed in the region of the elevated part (67), wherein the locking tongue (33) is nailed by means of a nail (73) along said axial shaft (72), as the nail passes through an opening (67*a*) of the elevated part (67) and wherein said blades (68,69) are provided with holes (68*a*,69*a*) respectively for being nailed onto nails (70*a*, 71*a*) of the main body of the internal cover plug means (60), and a main body of external cover plug means (61) positioned into an opening of profile (1) in the region of said chamber (5), exactly opposite the main body of said internal cover plug means (60), said external cover plug means (61) comprising internally threaded tubular members (63) on either side thereof, a pair of bolts (64) being employed to pass through holes (62) of the main body of said internal cover plug means (60) and subsequently be screwed within said threaded tubular members (63) of said external cover plug means (61) to render a compact structure of said locking mechanism which acts in response to reciprocating movement of said plastic cover (76) to sequentially render reciprocating movement of said button means (80) which is fixedly mounted onto the plastic cover (76) thereby initiating rotation of a certain arc length of said locking tongue (33) being pushed via said axial pin (86) which tracks the curvilinear path defined by either one of the pair of curvilinear legs (91*a*, 91*b*), thereby said locking tongue (33) protruding via said opening (32) into the chamber (4) of the profile (1) wherein said hooking mechanism is installed, so as to block movement of said rear terminal arm (26, 26*a*) and maintain said frontal terminal hooking arm (24) of said at least one hook profile (21) in a position of engagement within said suitably shaped recession of the facing part.

4. Lock assembly for sliding door/window panels according to the above claim 1, wherein said at least one vertically extending flat surface protruding at right angles from the interior surface of at least one of said parallel walls (1*a*,1*b*) of said vertically oriented sliding door/window panel profile (1) is alternatively selected to comprise either a formation of a surface (29) perpendicularly oriented onto at least one of said walls (1*a*, 1*b*) of the frontal chamber (4) of said profile (1) or of an independent profile (48) in which a flat surface (49) is perpendicularly oriented onto at least one of said walls (1*a*, 1*b*) of the frontal chamber (4) of said profile (1), an angular portion (42*a*,42*b*) of said independent profile (48) being used for mounting said independent profile (48) onto the walls of said profile (1) and wherein said facing part located onto said vertically oriented protruding part (3) of the fixed frame profile (2) is alternatively selected to consist of either a formation onto the frontal surface of said vertically oriented protruding part (3) of the fixed frame profile (2) including a frontal surface (30) whereupon collides said sliding/rotating arm (25) to initiate rotation of said at least one hook profile (21) and at least one vertically extending recession (30*a*) adapted to receive said frontal terminal hooking arm (24) of said at least one hook profile (21) or of an independent profile (43) mounted onto said vertically oriented protruding part (3) of the fixed frame profile (2) and including a frontal surface (40) whereupon collides said sliding/rotating arm (25) to initiate rotation of said at least one hook profile (21) and at least one vertically extending recession (40*a*) adapted to receive said frontal terminal hooking arm (24) of said at least one hook profile (21).

5. Lock assembly for sliding door/window panels according to the above claim 4, said lock assembly being adapted to operate as a device of unilateral locking comprising a single hook profile (21) rotatably connected to a single vertically extending flat surface protruding at right angles from the interior surface of one of said parallel walls (1*a*,1*b*) of said vertically oriented sliding door/window panel profile (1) and alternatively selected to comprise either a formation of a surface (29) perpendicularly oriented onto one of said walls (1*a*,1*b*) of the frontal chamber (4) of said profile (1) or of an independent profile (48) in which a flat surface (49) is perpendicularly oriented onto one of said walls (1*a*,1*b*) of the frontal chamber (4) of said profile (1), and cooperating with a facing part located onto the vertically oriented protruding part (3) of the fixed frame profile (2) and alternatively selected to comprise either a formation onto the frontal surface of said vertically oriented protruding part (3) of the fixed frame profile (2) including a frontal surface (30) whereupon collides said sliding/rotating arm (25) to initiate rotation of said single hook profile (21) and one vertically extending recession (30*a*) adapted to receive said frontal terminal hooking arm (24) of said single hook profile (21) or an independent profile (43) mounted onto said vertically oriented protruding part (3) of the fixed frame profile (2) and including a frontal surface (40) whereupon collides said sliding/rotating arm (25) to initiate rotation of said single hook profile (21) and one vertically extending recession (40*a*) adapted to receive said frontal terminal hooking arm (24) of said single hook profile (21).

6. Lock assembly for sliding door/window panels according to the above claim 4, said lock assembly being adapted to operate as a device of bilateral locking comprising a pair of hook profiles (21) rotatably connected, one opposite to the other, to vertically extending flat surfaces protruding at right angles from the interior surface of said two parallel walls (1*a*,1*b*) of said vertically oriented sliding door/window panel profile (1), each one of said vertically extending flat surfaces protruding at right angles from the interior surface of said two parallel walls (1*a*,1*b*) being alternatively selected to consist of either a formation of a surface (29) perpendicularly oriented onto one of said walls (1*a*,1*b*) of the frontal chamber (4) of said profile (1) or of an independent profile (48) in which a flat surface (49) is perpendicularly oriented onto one of said walls (1*a*,1*b*) of the frontal chamber (4) of said profile (1), and cooperating with a facing part located onto the vertically oriented protruding part (3) of the fixed frame profile (2) and alternatively selected to comprise either a formation onto the frontal surface of said vertically oriented protruding part (3) of the fixed frame profile (2) including a frontal surface (30) whereupon collide said sliding/rotating arms (25) to initiate rotation of said pair of hook profiles (21) and a pair of vertically extending recessions (30*a*,30*b*) adapted to correspondingly receive said frontal terminal hooking arms (24) of said pair of hook profiles (21) or an independent profile (43) mounted onto said vertically oriented protruding part (3) of the fixed frame profile (2) and including a frontal surface (40) whereupon collide said sliding/rotating arms (25) to initiate rotation of said pair of hook profiles (21) and a pair of vertically extending recessions (40*a*,40*b*) adapted to receive said frontal terminal hooking arms (24) of said pair of hook profiles (21).

7. Lock assembly for sliding door/window panels according to the above claim 1, wherein rotatable connection of said at least one hook profile (21) to said at least one vertically extending flat surface protruding at right angles from the interior surface of at least one of said parallel walls (1*a*,1*b*) is alternatively selected to be effected either with said centre (27) for rotatable connection of said hook profile (21) being a cylindrical shaft (27*b*) fitted within a correspondingly dimensioned receiving recession (31*a*) of said terminal shaping of a centre for the rotatable connection of the hook profile (21) at said vertically extending flat surface protruding at right angles from the interior surface of at least one of said parallel walls (1*a*,1*b*) or with said centre (27) for rotatable connection of said hook profile (21) being a cylindrical recession (27*a*) which receives a correspondingly dimensioned cylindrical shaft (31) of said terminal shaping of a centre for the rotatable connection of the hook profile (21) at said vertically extending flat surface protruding at right angles from the interior surface of at least one of said parallel walls (1*a*,1*b*).

* * * * *